United States Patent [19]

Hipp

[11] Patent Number: 4,958,691

[45] Date of Patent: Sep. 25, 1990

[54] FLUID OPERATED VIBRATORY JAR WITH ROTATING BIT

[76] Inventor: James Hipp, 110 Lietmeyer St., New Iberia, La. 70560

[21] Appl. No.: 367,341

[22] Filed: Jun. 16, 1989

[51] Int. Cl.[5] ..... E21B 1/00; E21B 4/14

[52] U.S. Cl. ..... 175/296; 173/78; 173/110; 175/106; 175/305; 175/322

[58] Field of Search ..... 175/296, 299, 101, 93, 175/106, 305, 306, 322, 110, 80, 78, 73

[56] References Cited

U.S. PATENT DOCUMENTS

| | | | |
|---|---|---|---|
| 1,654,833 | 1/1928 | Rice, Jr. | 173/110 X |
| 1,934,252 | 11/1933 | Baker | 173/110 |
| 2,755,069 | 7/1956 | Mosby | 173/73 X |
| 3,946,819 | 3/1976 | Hipp | 175/296 |
| 3,978,931 | 9/1976 | Sudnishnikov et al. | 173/110 X |
| 4,209,070 | 6/1980 | Sudnishnikov et al. | 173/78 |
| 4,462,471 | 7/1984 | Hipp | 175/296 |

*Primary Examiner*—Hoang C. Dang

*Attorney, Agent, or Firm*—Pravel, Gambrell, Hewitt, Kimball & Krieger

[57] ABSTRACT

A downhole oil well tool uses impact, reciprocal drilling and an improved rotating bit or like working member, receiving both fluid pressure and weight from an elongated pipe string with a flow bore in order to drive the tool. A valve within tool housing controls fluid pressure to the working end so that the tool pressures up, then releases pressure through the working member allowing the pipe string to load the bit, creating impact. A clutch rotates the working member during drilling to prevent imprint upon the formation.

13 Claims, 3 Drawing Sheets

FLUID OPERATED VIBRATORY JAR WITH ROTATING BIT

BACKGROUND OF THE INVENTION

1. Field of the Invention

The present invention relates generally to downhole oil well tools namely run on a pipe string, impact or jarring type downhole oil well tools, and more particularly, to a fluid operated jarring tool for use in well bores that jars upwardly and downwardly and wherein the tool has a bit or working end that rotates when the bit is not subject to weight of the pipe string in order to prevent imprinting on the drilling surface.

2. General Background

In downhole well operation, there is a need for jarring or impact devices. For example, in workover operations using a pipe string such as coil tubing or snubbing equipment, it is necessary to provide downward jarring impact at the bottom of the string to enable the string to pass obstructions or otherwise enter the well. During fishing operations or other operations, such as paraffin scraping, it is sometimes necessary to apply upward jarring or impact forces at the bottom of the string if the fishing tool or the like becomes stuck.

In prior U.S. Pat. No. 3,946,819, naming the applicant herein as patentee, there is disclosed a fluid operated well tool adapted to deliver downward jarring forces when the tool encounters obstructions. The tool of my prior U.S. Pat. No. 3,946,819, generally includes a housing with a tubular stem member telescopically received in the housing for relative reciprocal movement between a first terminal position and a second terminal position in response to fluid pressure in the housing. The lower portion of the housing is formed to define a downwardly facing hammer and the stem member includes an upwardly facing anvil which is positioned to be struck by the hammer. The tool includes a valve assembly that is responsive to predetermined movement of the stem member toward the second terminal position to relieve fluid pressure and permit the stem member to return to the first terminal position. When the valve assembly relieves fluid pressure, the hammer moves into abrupt striking contact with the anvil. The tool of prior U.S. Pat. No. 3,946,819, is effective in providing downward repetitive blows. The tool of the '819 patent will not produce upwardly directed blows.

In prior U.S. Pat. No. 4,462,471, naming the applicant herein as patentee, there is provided a bidirectional fluid operated jarring apparatus that produces jarring forces in either the upward or downward direction. The jarring apparatus was used to provide upward or downward impact forces as desired downhole without removing the tool from the well bore for modification. The device provides downward jarring forces when the tool is in compression, as when pipe weight is being applied downwardly on the tool, and produces strong upward forces when is in tension, as when the tool is being pulled upwardly.

In U.S. Pat. No. 4,462,471, there is disclosed a jarring or drilling mechanism that may be adapted to provide upward and downward blows. The mechanism of the '471 patent includes a housing having opposed axially spaced apart hammer surfaces slidingly mounted within the housing between the anvil surfaces. A spring is provided for urging the hammer upwardly. When it is desired to use the mechanism of the '471 patent for jarring, a valve including a closure and a compression spring is dropped down the string to the mechanism.

In general, the mechanism of the '471 patent operates by fluid pressure acting on the valve and hammer to urge the valve and hammer axially downwardly until the downward movement of the valve is stopped, preferably by the full compression of the valve spring. When the downward movement of the valve stops, the seal between the valve and the hammer is broken and the valve moves axially upwarly.

The direction jarring of the mechanism of the '471 patent is determined by the relationship between the fluid pressure and the strength of the spring that urges the hammer upwardly. Normally, the mechanism is adapted for upward jarring. When the valve opens, the hammer moves upwardly to strike the downwardly facing anvil surface of the housing. The mechanism can be made to deliver a downward and upward blow by increasing the fluid pressure and decreasing the strength of the spring that urges the hammer upwardly. When the mechanism is so arranged, the downward momentum of the hammer is increased such that the hammer strikes the upwardly facing anvil of the housing prior to being urged upwardly to strike the downwardly facing anvil surface. The mechanism of the '471 patent can be adapted to produce only downward forces by either shortening the length of the valve spring or by lengthening the valve such that the valve recloses prior to the hammers reaching the downwardly facing anvil surface on the upstroke.

One of the problems with these prior art devices is the fact that during impact drilling, imprinting on the drilling surface can occur reducing or preventing penetration. The present invention rotates the working end, eg. a drill bit, during impact drilling. With the present invention, by rotating the bit when it is not subject to weight of the pipe string, very little energy is required. As compared to rotating the bit when it is weighted, this "unweighted" rotation slows bit wear. Thus, impact drilling can proceed with a constant movement or rotation of the bit to prevent imprinting on the drilling surface.

SUMMARY OF THE PRESENT INVENTION

The present invention provides an improved well tool for use with an elongated pipe string that can load the tool transmitting impact thereto. The tool includes a housing connectable to and in fluid communication with the lower end of a pipe string, and defining at least one fluid chamber therein. A tubular stem having a flow channel therethrough is telescopically received by the housing for relative reciprocal movement and sealing engagement therewith between a first "pressured up" unloaded and a second "impact" loaded position.

An impact receptive working member is attached to one end of the stem for relative movement therewith between the first and second positions, wherein impact is transmitted to the working member in the second impact position.

A valve carried by the housing is operable by fluid pressure transmitted by the pipe string, and responsive to a predetermined movement of the stem with respect to the housing relieves fluid pressure in the tool housing permitting return of the stem and the housing to the first "pressure up" position.

Biasing springs disposed in the chamber bias the stem member and the housing toward the first position and bias the valve means into a closed position when the stem member and the housing are in the first "pressure up" position. An interface between the housing and the stem rotate the working member during relative movement of the housing and the stem.

In the preferred embodiment, the interface includes a clutch assembly for rotating the working member in one rotational direction and for preventing rotation of the working member in the opposite rotational direction.

In the preferred embodiment, the interface comprises a clutch assembly with a sleeve positioned concentrically between the housing and the stem for rotating the working member when the housing and stem move relative to one another.

In the preferred embodiment, the clutch assembly includes a tubular member having one or more spiralling and longitudinally extending slots and the slots define a track, and a corresponding number of pins connects the housing and tubular stem together.

In the preferred embodiment, the interface rotates the working member at least partially when the working member is unloaded.

In the preferred embodiment, the working member is rotated prior to loading of the working member with the pipe string.

In the preferred embodiment, the tubular stem is contained within the housing and the interface sleeve is positioned concentrically between the housing and the stem.

In the preferred embodiment, the interface includes a tubular member having an enlarged lower end that engages the housing upon impact transmitted to the bit.

In the preferred embodiment, the valving means includes a tubular valve element having a fluid port therethrough, one end portion communicating with the fluid chamber and the other end portion positioned to form a fluid seal with the tubular stem for stopping fluid flow therethrough to the working member.

In the preferred embodiment, the tubular stem is an elongated generally cylindrical stem with a central stem flow bore or channel therethrough and the flow bore or channel is in fluid communication with the working member.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
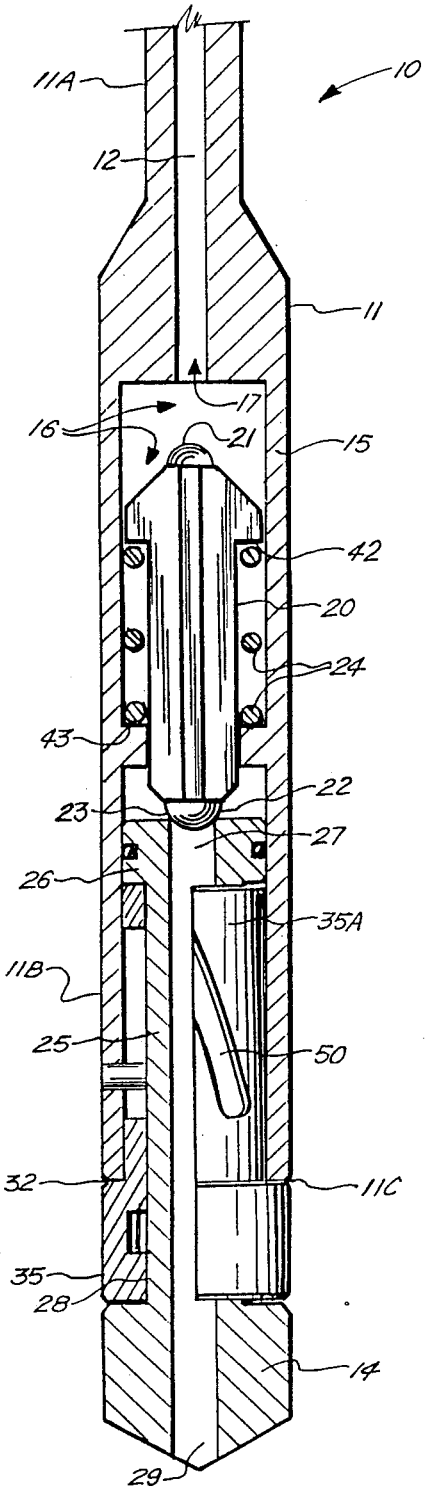
FIG. 1 is a sectional elevational view of the preferred embodiment of the apparatus of the present invention during impact.

FIGS. 1–4 illustrate the preferred embodiment of the apparatus of the present invention designated generally by the numeral 10. In FIGS. 1–4, there can be seen sequential sectional elevational views showing operation of the tool beginning with the post impact position (immediately prior to pressuring up) that is shown in FIG. 1 and ending with the tool impact position shown in FIG. 4.

Otherwise, the component parts and construction of the apparatus 10 can be seen by viewing the FIGS. 1–4 at one time.

The apparatus 10 includes a housing 11 having upper 11A and lower 11B end portions. The housing provides at upper end portion 11A, a longitudinally extending port 12. The upper end portion 11A of the tool body 11 can be attached for example to a running and pulling sub (not shown) which is then attached to a pipe string such as, for example, a coil tubing unit. The connection of the tool 10 to a coil tubing unit using a running an pulling sub is described generally in my prior U.S. Pat. Nos. 3,946,819 and 4,462,471 which are incorporated herein by reference.

The lower end portion 11B of the tool body 11 carries a working member such as drill bit 14. A central tubular section 13 of housing 11 with an annular wall 15 defines an internal fluid chamber 16. Chamber 16 communicates with port 12 at 17 so that fluid transmitted to the tool 11 through the pipe string of the coil tubing unit can be used to "pressure up" the tool by conveying pressurized fluid to the tool chamber 16 via port 12.

Figure 6:
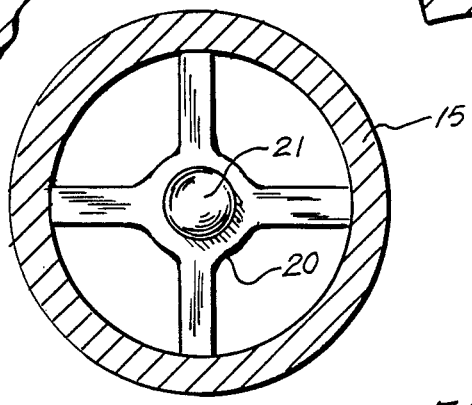
FIG. 6 is a sectional view taken along lines 6—6 of FIG. 4.

Fluid chamber 16 carries valving member 20, a longitudinally extending valve member having a generally X-shaped cross section such as the valving member shown in FIG. 6 of my prior U.S. Pat. No. 3,946,819.

Valve member 20 includes an upper 21 and lower 22 end portions. Lower end portion 22 can form a fluid tight seal at seat 23 with the upper end portion 26 of tubular stem 25. Coil spring 24 biases valving member 20 upwardly when the seal at seat 23 between lower end portion 22 of valve 20 and the upper end portion 26 of stem 25 is broken. Thus, 23 defines a valve seat for sealing the longitudinal flow bore 27 of stem 25.

The lower most end portion 28 of stem 25 carries working member 14, such as a drill bit. The central longitudinal stem flow bore 27 thus extends the full length of stem 25 communicating with the bore 29 of working member 14. When fluid flows downwardly in the tool 10 and more particularly through chamber 16 and into bore 27 of stem 25, flow can also communicate with and flow through bore 29 of working member 14, exiting the bit or working member 14, carrying away cuttings generated during drilling or like operations. The position of the tool 10 in FIG. 1 illustrates the impact position in that the housing 11 rests upon the bit 14 with the annular shoulder 11C of housing 11 resting upon the annular shoulder 32 of clutch 35.

The lowermost end portion of clutch member 35 is enlarged below shoulder 32. Clutch 35 allows only clockwise rotation of bit 14 during operation as viewed from the top view. This rotation also tightens all threaded connections of the tool apparatus 10..

Figure 2:
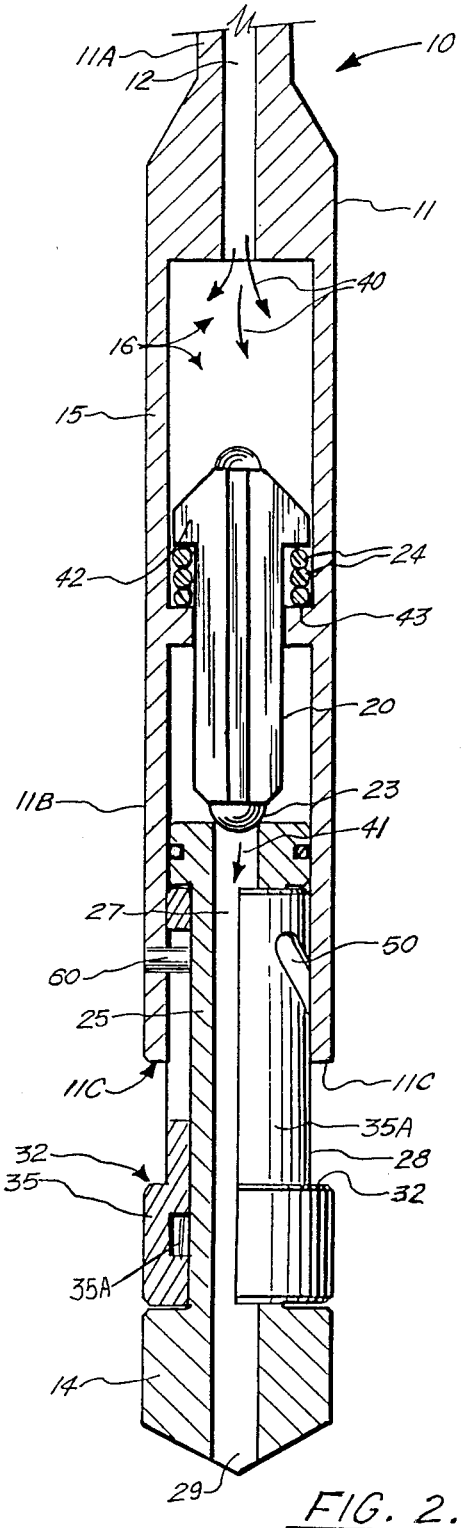
FIG. 2 is a sectional elevational view of the preferred embodiment of the apparatus of the present invention illustrating the tool in an unloaded position and with the valve closed.

In FIG. 2, a "pressured up" position is shown. Fluid under pressure is entering chamber 16 via port 12 (see arrows 40, FIG. 2) and forces housing 11 to rise with respect to stem 25 and bit 14. When member 11 starts its upward movement, the weight of the pipe string is supported by body 11, through stem 25, through bit 14 to the drilling surface. During this upward travel, member 35 is unloaded and the clutch allows the member 35 to rotate counter-clockwise around stem member 25, by means of the helix slots 50 and the pins 60.

Figure 3:
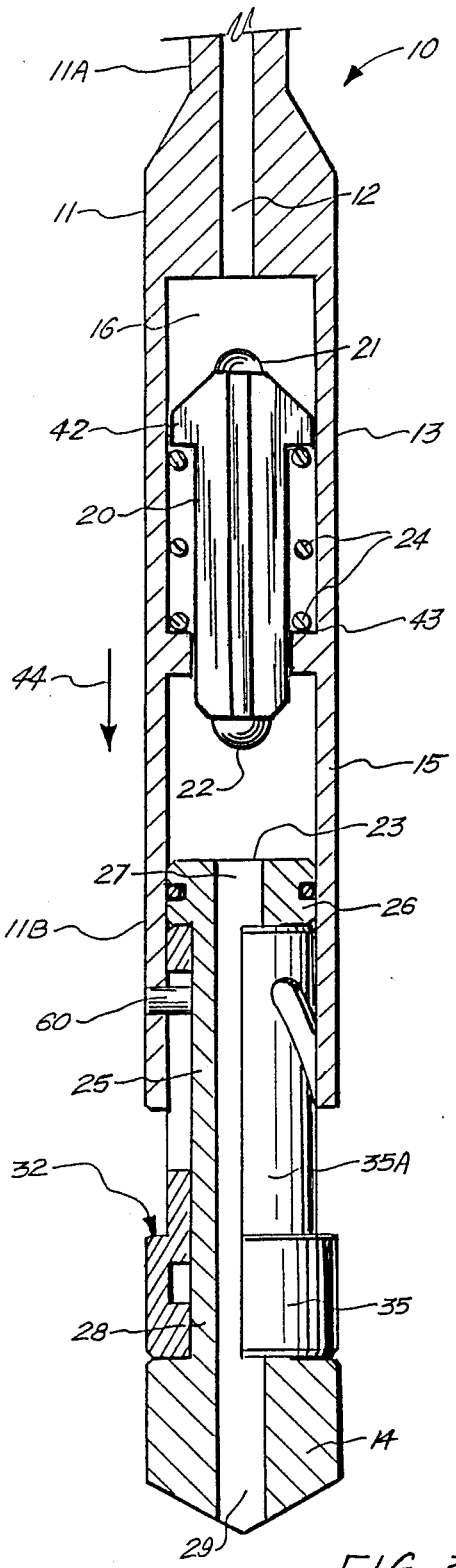
FIG. 3 is a sectional elevational view of the preferred embodiment of the apparatus of the present invention illustrating the tool in an unloaded position with the valve opened.
Figure 4:
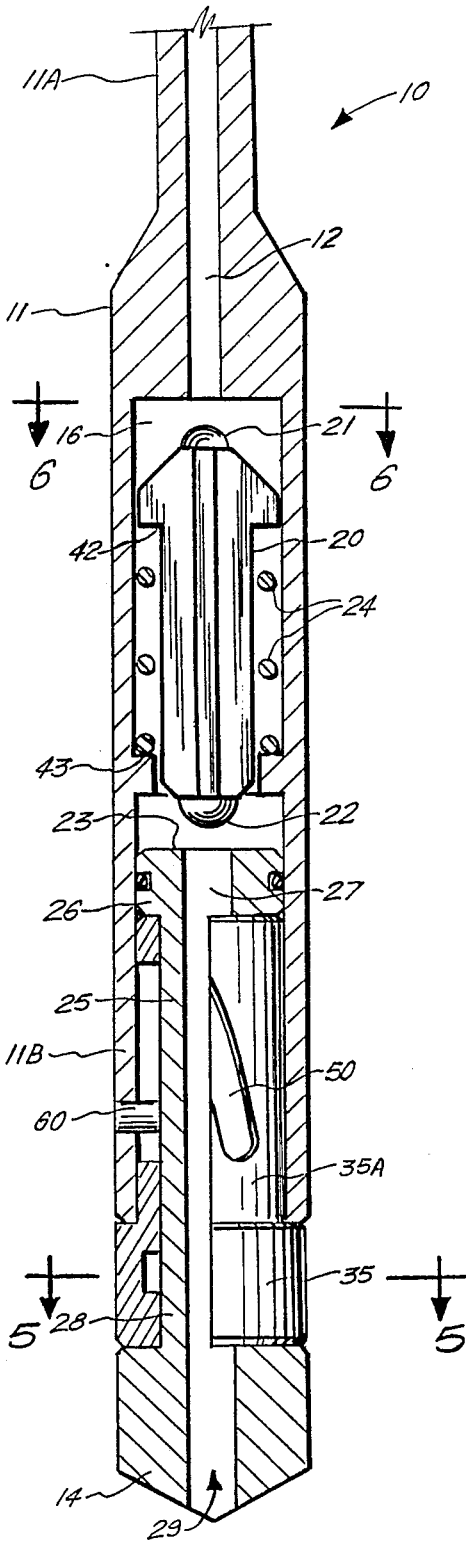
FIG. 4 is a sectional elevational view of the preferred embodiment of the apparatus of the present invention in the impact position with the valve opened.

The lowermost shoulder 11C of housing 11 is now spaced from the upper annular shoulder 32 of clutch 35. In the position of FIG. 2, coil spring 24 has been fully compressed, and the valve member 20 can move no further in the direction of arrow 41 with respect to housing 11 because the coil spring 24 is fully compressed above by shoulder 42 of valving member 20, and below by the annular shoulder 43 of tubular section 13. Because of the presence of pressurized fluid within fluid chamber 16, housing 11 continues to rise, carrying valving member 20 with it, and away from stem 25 until the seal at seat 23 is broken. Valve 20 travels with sleeve 11, the lower end 22 of valving member 20 lifts from the upper end 26 of stem 25 breaking the seal at 23 so that fluid contained within the chamber 16 is now free to discharge via the stem longitudinal flow bore 27 (FIG. 3).

Diagonal or helical slot 50 of clutch sleeve 35A has rotated upon pin 60 which is connected to the tubular section 13 of housing 11 and more particularly extends from the annular wall 15 portion thereof. The pressurized fluid contained in chamber 16 exits the tool 10 via stem longitudinal bore 27 and the bore 29 of working member 14. This exiting of pressurized fluid helps clean cuttings away from the drilling area.

When pressure within the tool chamber 16 equalizes with external pressure, nothing is preventing the full weight of the pipe string from thrusting the housing 11 downwardly. As the housing 11 moves downwardly as shown by the arrows 44 in FIG. 3, the pin 60 travels in spiralling slot 50 of sleeve 35A causing bit or working member 14 to rotate.

Figure 5:
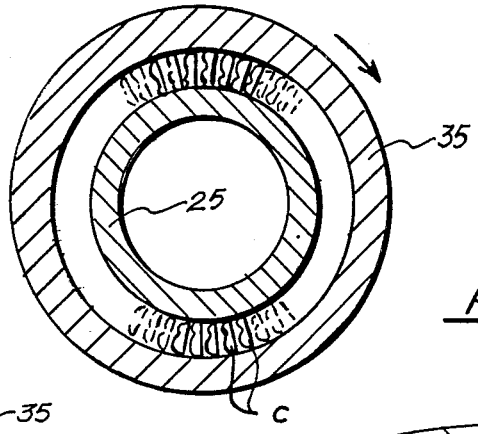
FIG. 5 is a sectional view taken along lines 5—5 of FIG. 4.
Figure 5A:
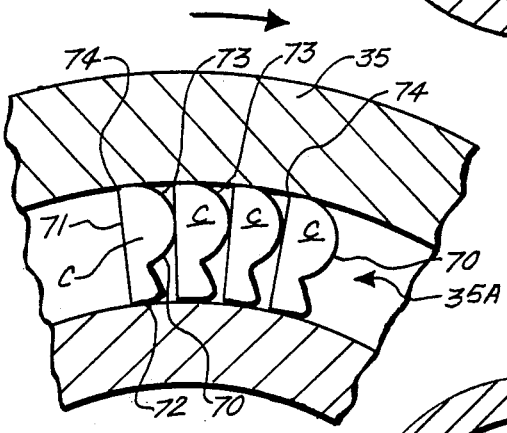
FIGS. 5A—5B are fragmentary views illustrating the locking cam portion of the clutch member.
Figure 5B:
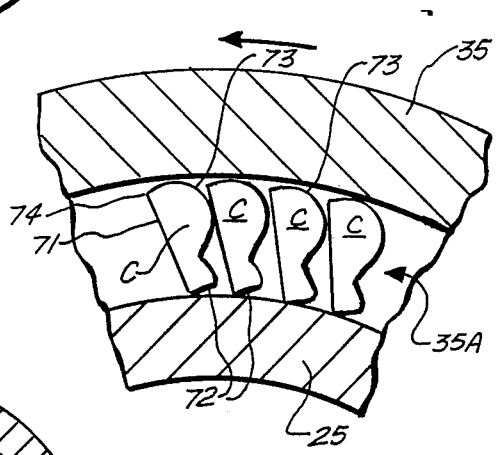

Clutch 35 is a single rotation directional clutch which only allows clockwise rotation of the bit 14. Clutch 35 (FIG. 5) uses a a plurality of small closely spaced cam members C. Such unidirectional clutch cam members C are commercially available. The cams C have flat upper and lower surfaces, and fit within recess 35A. Each cam C has a radially extending vertical surface 71 that is larger than its opposed vertical radial surface 70. Each cam has a smaller inner curved vertical surface 72 and a larger outer curved vertical surface 73. The outer curved surface thus has a locking tip 74 which binds against surface recess 35A when rotation is in one direction. However when rotation is in the opposite direction, the locking tip 74 rotates toward stem 25 so that binding is stopped and rotation permitted.

A feature of the present invention is that rotation of the bit thus takes place prior to loading of the bit with the housing and the pipe string. Notice in FIG. 3 that as the pin 60 moves downwardly through spiralling slot 50, rotation of the bit takes place. It is not until the lower annular shoulder 11C of housing 11 strikes the upper annular shoulder 32 of clutch 35 that the impact is transmitted from the housing 11 and the pipe string directly to the working member 14 (see FIG. 4).

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A well tool for use with an elongated pipe string that can load the tool transmitting impact thereto and with a flow bore for transmitting pressurized fluid to the tool comprising:

(a) a housing having means for connecting said tool in fluid communication with the lower end of a pipe string and defining at least one fluid chamber therein for receiving pressurized fluid transmitted from the pipe string thereto;

(b) tubular stem means having a flow channel therethrough communicating with the fluid chamber, the stem means telescopically received by said housing for relative reciprocal movement therewith between a first "pressured up" unloaded position and a second "impact" loaded position;

(c) an impact receptive working member attached during use to one end of said tubular stem means for movement therewith between said first and second positions, wherein impact is transmitted to the working member in the second impact position;

(d) valve means carried in said housing for controlling the flow of pressurized fluid in the fluid chamber and reciprocally movable therein between first and second positions, said valve means being operable to relieve fluid pressure within the fluid chamber responsive to predetermined movement of said stem means relative to said housing, permitting relative movement of said stem means and housing into said second "impact" position;

(e) biasing means disposed in said chamber, biasing said valve means upwardly into an open flow position when said stem member and housing are in said first unloaded position so that pressurized fluid can flow between the pipe string flow bore and the tubular stem flow channel; and (f) means interfacing said housing and said stem means for rotating said working member during relative movement of said housing and stem means at least between said first "pressured up" and second "impact" position, including clutch means concentrically positioned between the stem means and the housing and extendable below the housing for rotating the working member in one direction when unloaded by the work string.

2. THe apparatus of claim 1 wherein the clutch assembly includes a tubular member having one or more spiralling, longitudinally extending slots and the slots define a track for a corresponding number of pins each connecting the housing and tubular stem together.

3. The apparatus of claim 1 wherein the interfacing means rotates the working member when the working member is unloaded.

4. The apparatus of claim 3 wherein the working member is rotated prior to a loading of the working member with the pipe string.

5. The apparatus of claim 1 wherein the interfacing means includes a tubular clutch having an enlarged lower end that engages the housing upon impact transmitted to the working member.

6. The apparatus of claim 1 wherein the valving means includes a valve element having a longitudinal fluid port, one end portion communicating with the fluid chamber, and a second end portion positioned to form a fluid seal with the tubular stem means for stopping fluid flow therethrough.

7. The apparatus of claim 6 wherein the tubular stem means is an elongated generally cylindrical stem with a central flow channel therethough and the stem flow channel is in fluid communication with the working member.

8. An impact, driven well tool for use with an elongated tubular pipe string having a central flow conveying bore for channelling pressurized fluid to the tool, comprising:

(a) an elongated longitudinally extending tool body having means for connecting the tool body to the pipe string;
(b) a fluid chamber in the tool body in fluid communication with the pipe string bore;
(c) a stem reciprocally movable within the tool body in a telescoping fashion, the stem having a lower end portion for carrying a working member;
(d) pressure responsive valve means for controlling relative movement of the stem and tool body; and
(e) clutch means concentrically positioned between the stem and the body and extendable below the tool body for rotating the working member in one direction during a downward movement of the tool body relative to the stem.

9. The apparatus of claim 8 wherein the clutch means includes a sleeve with one or more slots therein, and a corresponding plurality of pins registering with the slots.

10. The apparatus of claim 9 wherein the slots are spiralling, longitudinally extending slots.

11. The apparatus of claim 8 wherein the stem has a longitudinal stem bore.

12. The apparatus of claim 11 wherein the valve means is movable between pressured and impact positions, wherein the valve means stops fluid flow to the working member in the pressured position, and allows fluid flow to the working member via the stem bore in the impact position.

13. A well tool for use with an elongated pipe string that can load the tool transmitting impact thereto and with a flow bore for transmitting fluid pressure to the tool comprising:

(a) a housing having means for connecting said tool in fluid communication with the lower end of a pipe string and defining at least one fluid chamber therein for receiving fluid pressure transmitted from the pipe string thereto;
(b) tubular stem means having a flow channel therethrough communicating with the fluid chamber, the stem being telescopically received by said housing for relative reciprocal movement therewith in between a first "pressured up" unloaded position and a second "impact" loaded position;
(c) an impact receptive working member attached to one end of said stem means for said relative movement therewith between said first and second positions, wherein impact is transmitted to the working member in the second impact position;
(d) valve means carried within the housing for controlling the flow of fluid under pressure in the fluid chamber during said reciprocal movement, said valve means being operable to relieve fluid pressure within the fluid chamber responsive to a predetermined movement of the stem means relative to the housing, permitting relative movement of said stem means and housing into said second "impact" position;
(e) biasing means disposed in said chamber, biasing said valve means upwardly into an open flow position when said stem member and housing are in said first unloaded position so that pressurized fluid can flow between the pipe string flow bore and the tubular stem flow channel;
(f) means interfacing said housing and said stem means for rotating said working member during relative movement of said housing and stem means at least between said first "pressured up" and second "impact" position; and
(g) wherein the interfacing means includes a tubular clutch positioned concentrically between the housing and the stem means for rotating the working member in one direction when the housing and stem means move relative to one another, the clutch having an enlarged lower end that engages the housing upon impact transmitted to the working member.

* * * * *